US005358100A

United States Patent [19]

Wolff

[11] Patent Number: 5,358,100

[45] Date of Patent: Oct. 25, 1994

[54] COSMETIC AND JEWELRY ORGANIZER

[75] Inventor: Stacy L. Wolff, Akron, Ohio

[73] Assignee: Rubbermaid Incorporated, Wooster, Ohio

[21] Appl. No.: 2,476

[22] Filed: Jan. 8, 1993

[51] Int. Cl.[5] ..... B65D 85/20

[52] U.S. Cl. ..... 206/45.11; 132/315; 206/45.15; 206/6.1; 206/581; 206/823; 206/509; 220/761

[58] Field of Search ..... 132/286, 287, 294–297, 132/301, 314, 315, 316, 291, 304; 190/21, 17, 29–35, 109; 206/45.14, 6.1, 45.19, 15.15, 315.11, 372, 373, 566, 581, 823, 503, 508, 509, 443, 446, 45.11; 220/500, 503, 522, 761; 312/127, 266

[56] References Cited

U.S. PATENT DOCUMENTS

| | | | |
|---|---|---|---|
| D. 325,123 | 4/1992 | Tiramani | D3/39 |
| 303,783 | 8/1884 | Zimmerman | 190/17 |
| 1,121,232 | 12/1914 | Davis | 206/443 |
| 1,257,385 | 2/1918 | Paroly | 220/761 |
| 1,510,763 | 10/1924 | Canal | 190/110 |
| 1,600,830 | 9/1926 | Lewis | 190/110 |
| 2,019,083 | 10/1935 | Loftin | 312/266 |
| 2,219,597 | 10/1940 | Lutz . | |
| 2,374,037 | 4/1945 | Piker | 312/266 |
| 3,410,018 | 11/1968 | Woolworth | 206/315.11 |
| 4,505,388 | 3/1985 | Solomon | 206/508 |
| 5,035,319 | 7/1991 | Kunisch | 206/6.1 |

OTHER PUBLICATIONS 2 catalog pages, Jammers ®, a Division of Plano Molding Company, 431 E. South Street, Plano, Ill. 60545–1601; 1992.

16 catalog pages, Caboodles, a Division of Plano Molding Company, 431 E. South Street, Plano, Ill. 60545–1601; 1992.

1 Page, Sassaby, Sassaby Ltd., Del Mar, Calif. 92014; 1991.

4 catalog pages, Tray Chic, Cosmepak, Division of FPI Thermoplastic Technologies, Hanover Avenue and Horsehill Road, P.O. Box 1907, Morristown, N.J. 07962–1907; undated.

4 catalog pages, Little Princess Hair & Jewelry Castle, Cosmepak, Division of FPI Thermoplastic Technologies, Hanover Avenue and Horsehill Road, P.O. Box 1907, Morristown, N.J. 07962–1907; undated.

*Primary Examiner*—Jimmy G. Foster

*Attorney, Agent, or Firm*—Renner, Kenner, Greive, Bobak, Taylor & Weber

[57] ABSTRACT

A container (10) for holding and storing items, such as cosmetics and jewelry, in an organized fashion includes a base portion (12) and a cover portion (11). Tray assemblies (48, 49) are connected to the base portion (12) by link arms (72, 92) for movement from a position within the base portion (12) to a position over the side walls (33, 34) of the base portion (12). Each tray assembly (48, 49) includes a tray having a plurality of compartments (61, 62, 83, 84) and pivotal holders (68, 86) which are specially configured to hold specific items of cosmetics and jewelry such as lipstick and earrings. A mirror case (50) is pivotally attached to the cover portion (11) and carries a mirror (54) therein.

19 Claims, 5 Drawing Sheets

FIG. 4
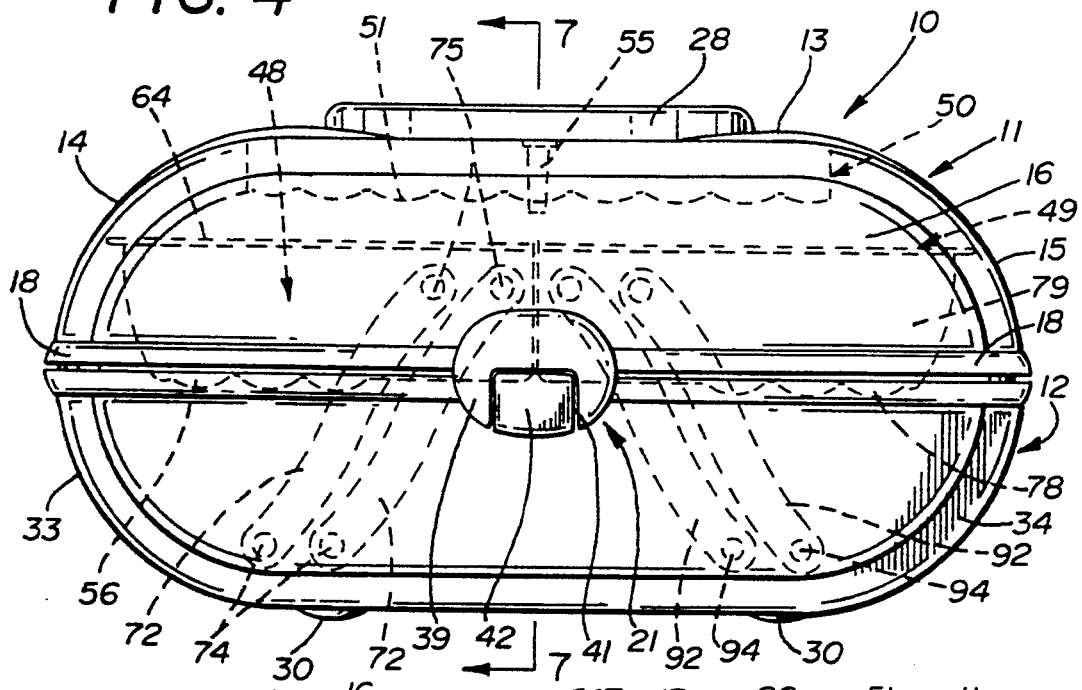
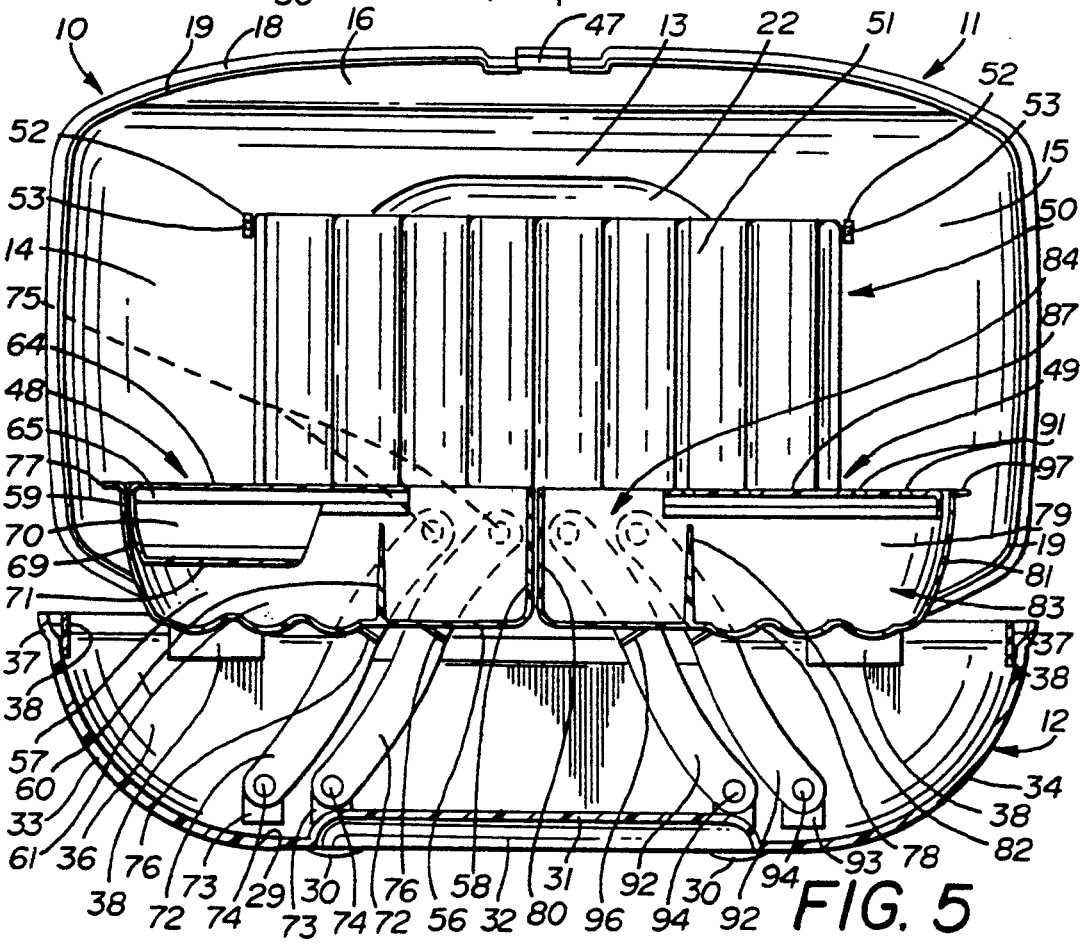
FIG. 5

COSMETIC AND JEWELRY ORGANIZER

TECHNICAL FIELD

This invention relates to a container for storing items, such as cosmetics, jewelry and the like, in an organized fashion. More particularly, this invention relates to a container which is compact yet uniquely configured to provide a variety of cosmetic or jewelry holding compartments, many of which are specially configured to hold a particular type of cosmetic or jewelry item.

BACKGROUND ART

Most containers specifically designed to store items of cosmetics, jewelry or the like are either in the form of soft-sided zippered pouches or are box-like structures having a hinged cover. When the cover is opened, a plurality of open compartments are exposed, much like a fishing tackle box, to hold, in a segregated fashion, selected items of cosmetics or jewelry. However, no such containers, of which I am aware, have compartments designed specifically to hold specifically configured cosmetic or jewelry items in a compact fashion, while still providing other storage capability for additional cosmetic and jewelry items of all configurations.

DISCLOSURE OF THE INVENTION

It is thus an object of the present invention to provide a container which is adapted to hold in an organized fashion various cosmetic and jewelry items.

It is another object of the present invention to provide a container, as above, which is compact in its closed position yet which will hold and give ready access to a relatively large volume of cosmetic and jewelry items.

It is a further object of the present invention to provide a container, as above, which has specially configured compartments for holding specific items such as lipstick and earrings while at the same time providing general storage space for other cosmetic and jewelry items.

It is an additional object of the present invention to provide a container, as above, which carries a mirror therein in a compact fashion.

It is yet another object of the present invention to provide a container, as above, which will readily stack in a nestable fashion with like containers so as to reduce shipping and display expense.

These and other objects of the present invention, as well as the advantages thereof over existing prior art forms, which will become apparent from the description to follow, are accomplished by the improvements hereinafter described and claimed.

In general, a container made in accordance with the present invention is designed to hold items of cosmetics, jewelry and the like of a specific configuration and other cosmetic and jewelry items of any configuration. The container includes a base portion which has a bottom surface and side walls and end walls extending upwardly therefrom to form an open top. A cover is provided to selectively close the open top. The base portion carries at least one tray assembly which includes a pivotal member configured to carry an item of specific configuration.

A preferred exemplary cosmetic and jewelry organizing container incorporating the concepts of the present invention is shown by way of example in the accompanying drawings without attempting to show all the various forms and modifications in which the invention might be embodied, the invention being measured by the appended claims and not by the details of the specification.

BRIEF DESCRIPTION OF THE DRAWINGS

FIG. 4 is a front elevational view of the cosmetic and jewelry organizing container in the closed, FIG. 1 position.

FIG. 5 is a front view shown partially in elevation and partially in section of the cosmetic and jewelry organizing container in a partially open condition.

PREFERRED EMBODIMENT FOR CARRYING OUT THE INVENTION

Figure 1:
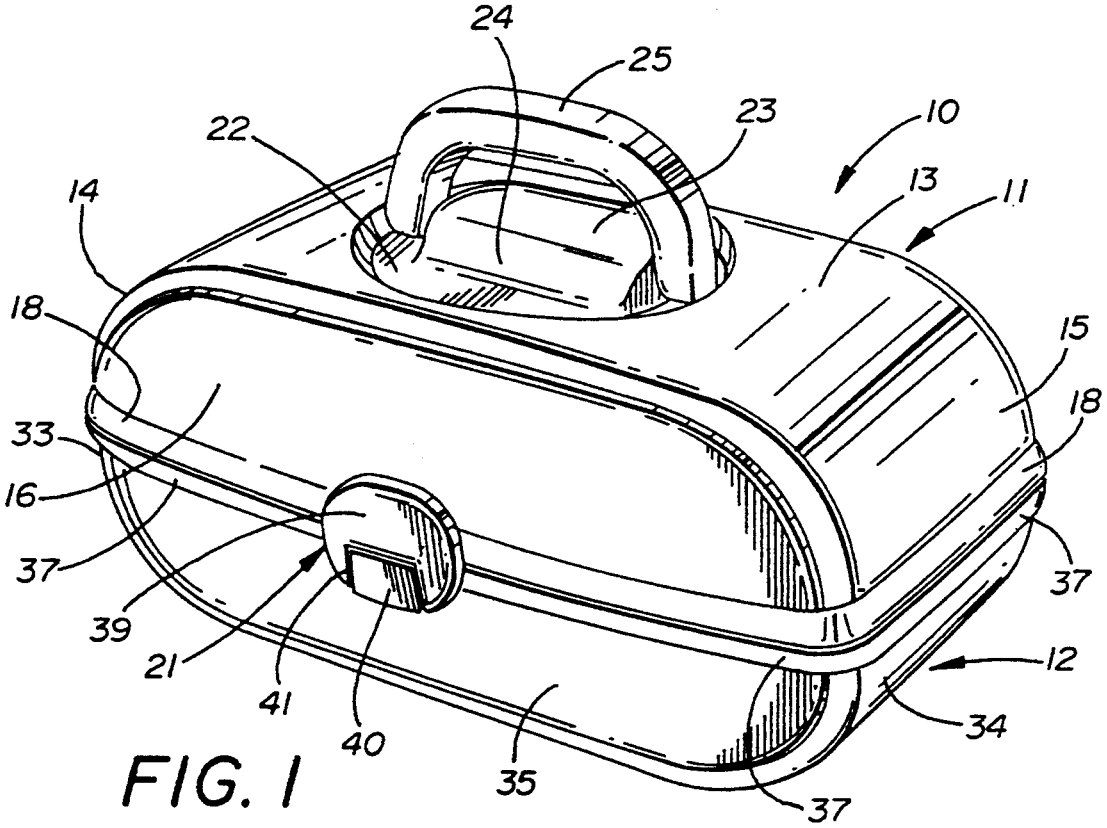
FIG. 1 is a perspective view of a cosmetic and jewelry organizing container made in accordance with the concepts of the present invention and shown in a closed condition.

A container for storing cosmetics, jewelry and the like in an organized fashion is indicated generally by the numeral 10 in the drawings. Container 10 is preferably molded of a polypropylene material and includes a cover portion generally indicated by the numeral 11 and a base portion generally indicated by the numeral 12. Cover 11 includes a top surface 13 which continues at its ends as downturned arcuate side surfaces 14, 15 and also includes arcuate front and rear surfaces 16 and 17, respectively. A skirt 18 is formed around the entire lower periphery of side surfaces 14, 15, front surface 16 and rear surface 17, and a peripheral lip 19 is spaced inwardly from skirt 18 to rest on the upper periphery of base 12 as will hereinafter be described. Rear surface 17 of cover 11 is pivotally attached to base portion 12 by a conventional hinge mechanism 20, and a latch mechanism, generally indicated by the numeral 21 and carried by base portion 12, secures the front of cover 11 to the front of base 12 as will be hereinafter described in more detail.

Figure 7:
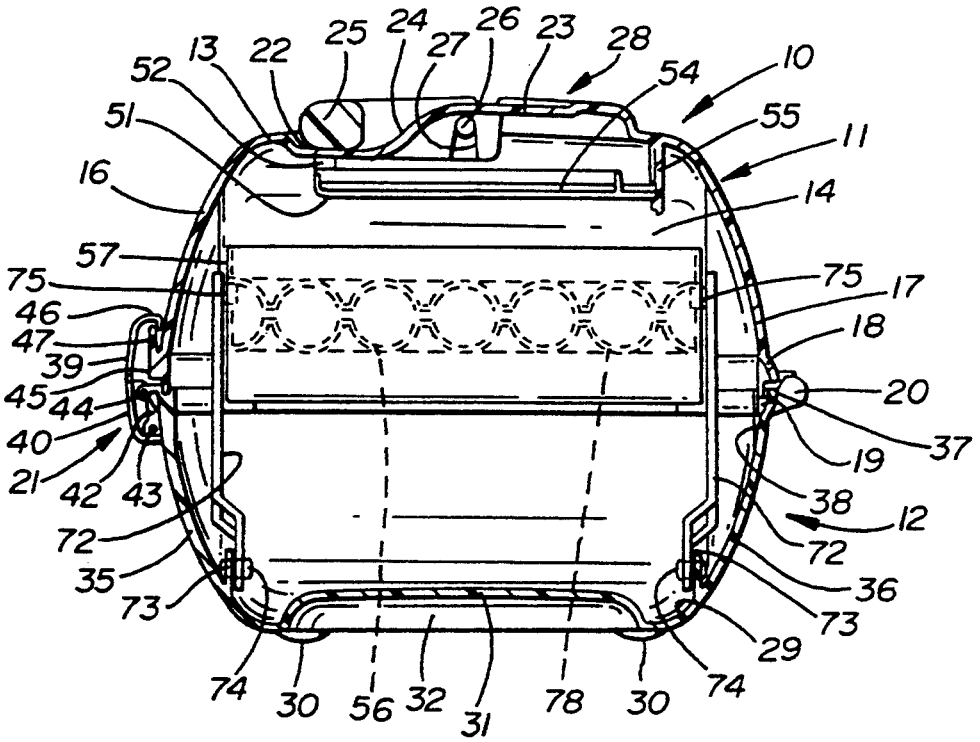
FIG. 7 is a sectional view taken substantially along line 7—7 of FIG. 4.

Top surface 13 is preferably provided with a U-shaped recess 22 generally defined by a central hub 23. As best shown in FIGS. 1 and 7, near the rear of cover 11, hub 23 extends above top surface 13 and then slopes downwardly, as at 24, to form the bottom of recess 22. A handle 25 is provided with inwardly directed pins 26 at the lower extremities thereof which are received in a slot 27 in hub 23 so that handle 25 is pivotable with respect to hub 23 from the upright, carrying position shown in FIG. 1, to a stored position shown in FIG. 2. In the stored position, handle 25 is partially within recess 22 such that the upper edge of handle 25 in the stored position is generally coincident with the uppermost portion of hub 23. As such, and as best shown in FIGS. 4 and 7, together, hub 23 and handle 25 form a locating lug 28 which, as will hereinafter be described, facilitates the nesting or stacking of one container 10 on another.

Base portion 12 includes a bottom surface 29 which is shown as having a plurality of small feet 30 formed therein and depending therefrom. A raised pedestal 31 forms a lower recess 32 in bottom surface 29, which recess is configured to complement the configuration of lug 28 of cover 11 so that, when like containers 10 are stacked or nested, lug 28 is received in recess 32 for a stable and convenient stacking of like containers which minimizes the potential lateral shifting thereof.

Bottom surface 29 continues at its ends as upturned arcuate side surfaces 33, 34 which complement the shape of cover side surfaces 14 and 15. Similarly, front surface 35 and rear surface 36 of base portion 12 extend upwardly from bottom surface 29 and complement front surface 16 and rear surface 17 of cover 11. Front surface 35 carries a portion of latch mechanism 21 and rear surface 36 carries a portion of hinge mechanism 20.

A skirt 37 is formed around the entire open upper periphery of base side surfaces 33 and 34, base front surface 35 and base rear surface 36 complementing skirt 18 on cover 11. A plurality of spaced shiplaps 38 are spaced inwardly from skirt 37 and the peripheral lip 19 of cover 11 is received between skirt 37 and shiplaps 38 when container 10 is in the closed condition.

Latch mechanism 21 can be of any conventional type but is shown, somewhat schematically in FIG. 7, as being of the type commonly known as an over-the-center latch mechanism. As such, latch mechanism 21 includes a latch handle 39 and a link arm 40 connecting handle 39 to base portion 12. As shown for example in FIGS. 1 and 4, link arm 40 is positioned within a generally U-shaped recess 41 formed in the lower portion of handle 39. As shown more schematically in FIG. 7, peripheral ribs 42 formed on link arm 40 receive pins 43 extending inwardly from the lower portion of handle 39 and into recess 41. Ribs 42 also carry another pin 44, positioned outwardly and above pins 43, pin 44 being received in a knuckle 45 extending outwardly from base portion front surface 35. The top of latch handle 39 is provided with a hook member 46 which is received in a locking lug 47 formed on front cover surface 16.

With latch mechanism 21 closed and holding cover 11 to base 12 by virtue of the fact that hook member 46 is engaging cover lug 47, as shown for example in FIGS. 1 and 7, latch mechanism 21 may be released by first lifting link arm 40 pivoting the same on pin 44. Such movement swings pins 43 to the left in FIG. 7 to pass the pivot point defined by pin 44 thereby loosening hook member 46 from lug 47. Once loosened, hook member 46 may be disengaged from lug 47 by slightly lifting latch handle 39, and both handle 39 and link arm 40 may be pivoted on pin 43 to the fully open position as shown, for example, in FIGS. 2 and 3. Of course, to reengage latch mechanism 21, handle 39 and link arm 40 may be pivoted upwardly on pin 43, hook member 46 inserted into lug 47, and link arm 40 pivoted on pin 44 back to the FIG. 7 position to draw hook member 46 into engagement with lug 47.

Figure 2:
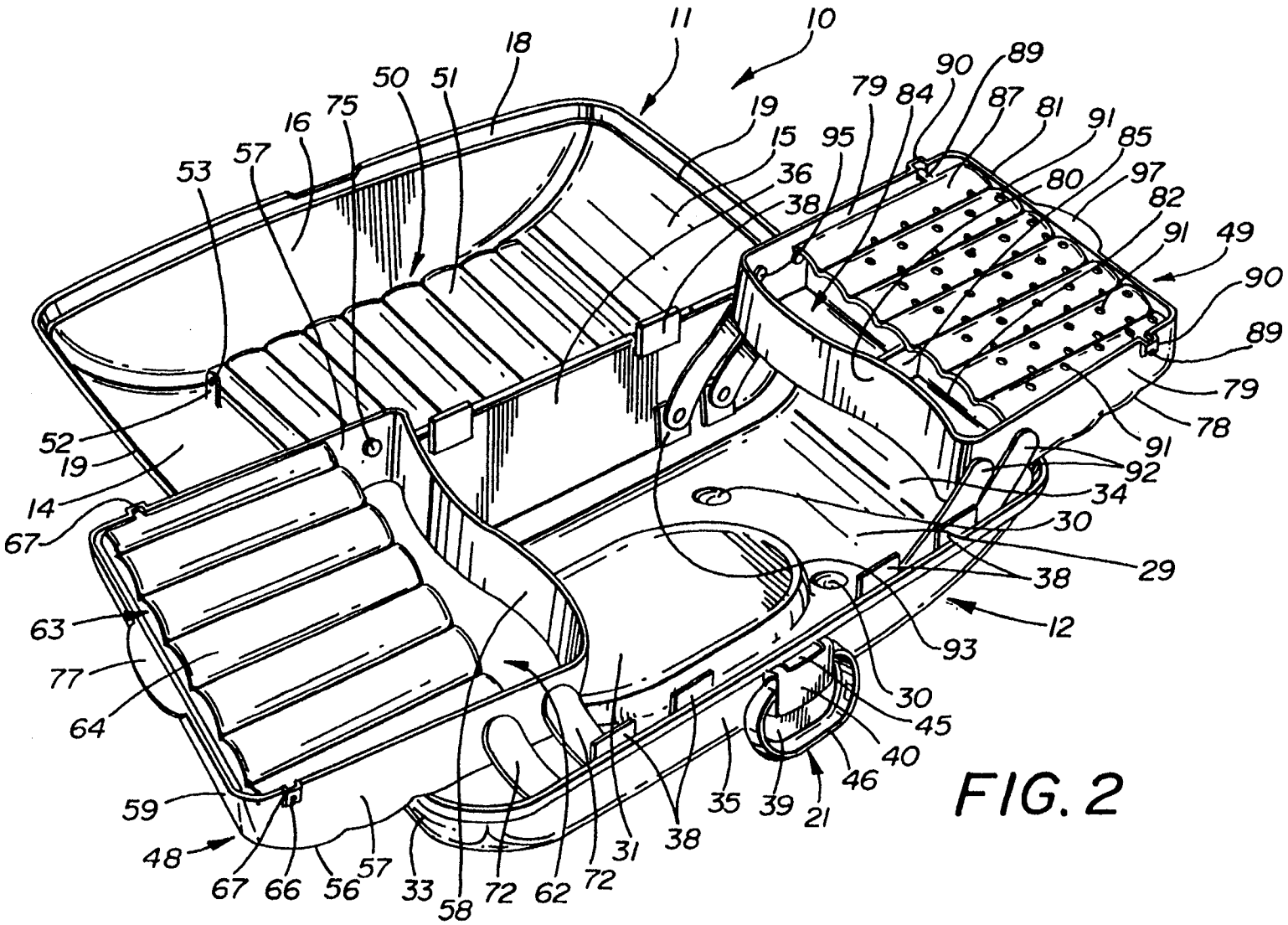
FIG. 2 is a perspective view of the cosmetic and jewelry organizing container shown in an open condition.
Figure 3:
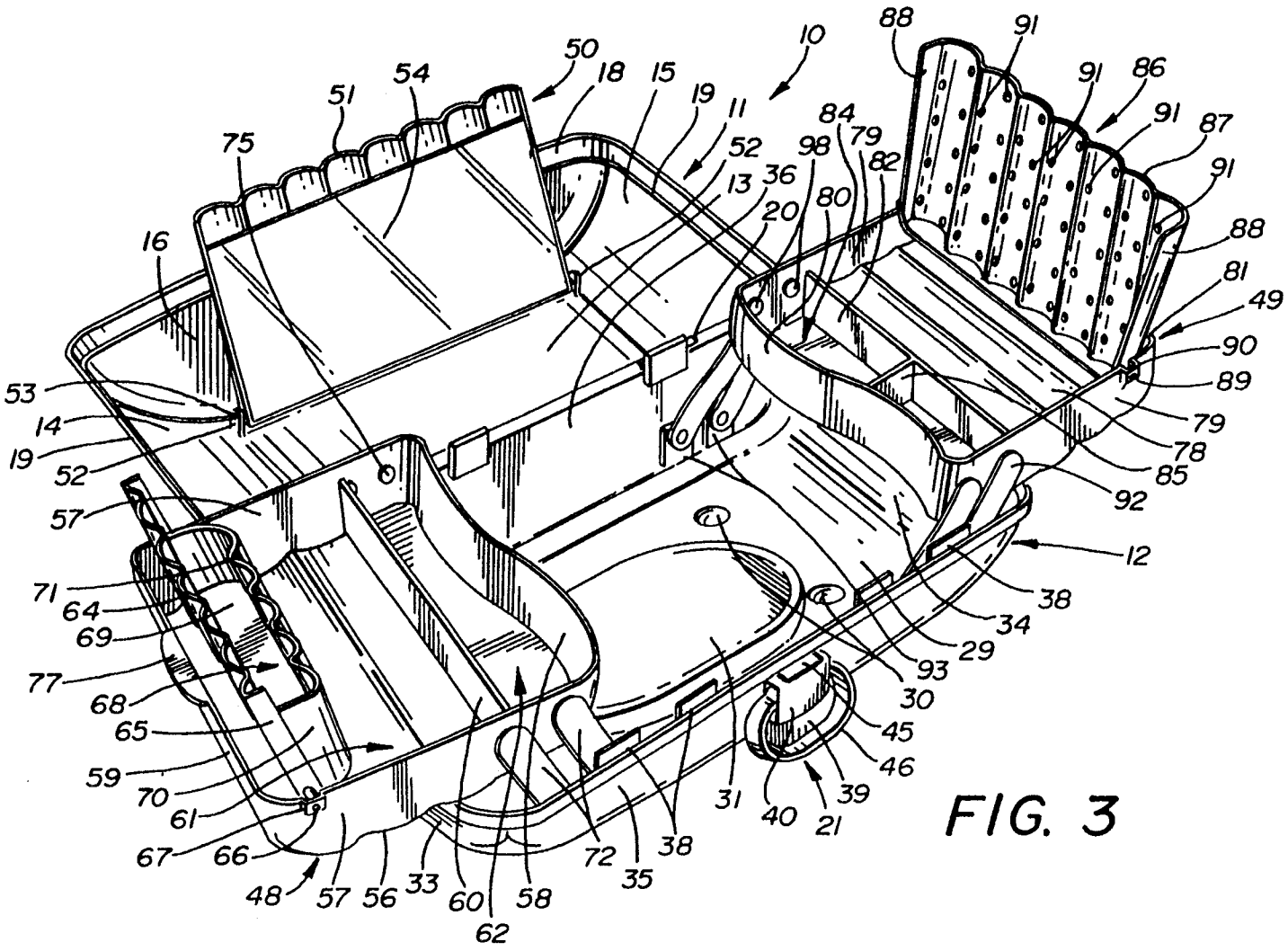
FIG. 3 is a perspective view similar to FIG. 2 but showing various items rotated to a position typically encountered during use.
Figure 6:
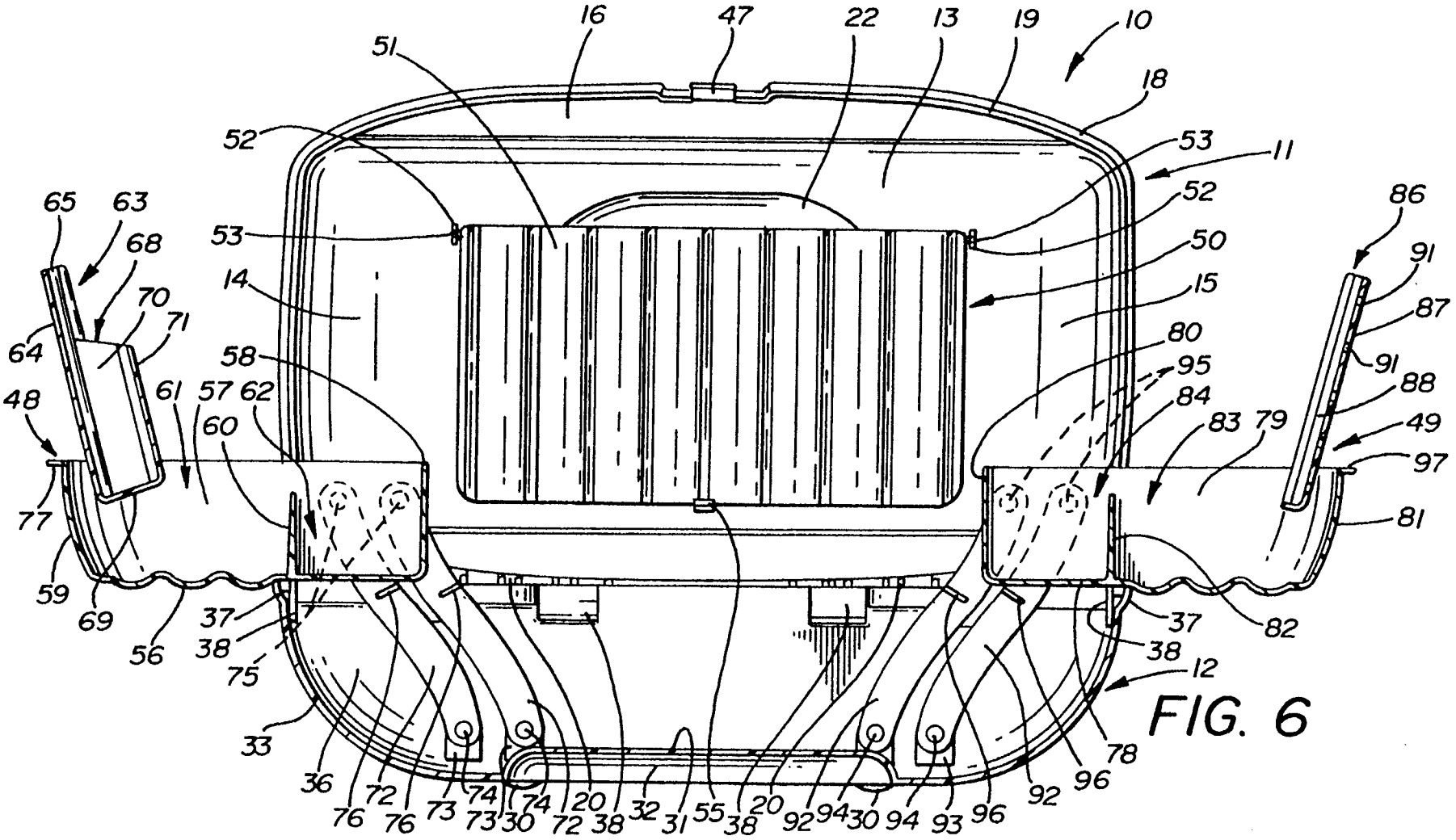
FIG. 6 is a front view shown partially in elevation and partially in section of the cosmetic and jewelry organizing container in another partially open condition.

FIG. 5 depicts container 10 as it is being opened, cover 11 having been swung relative to base portion 12 on hinge mechanism 20. It should be noted that in FIG. 5, and in FIG. 6 as well, cover 11 is being shown positioned approximately ninety degrees of base portion 12 which could only occur if cover 11 were manually being held or if cover 11 were resting, for example, against a wall, it being understood that if cover 11 is unrestrained, it will be positioned approximately one hundred eighty degrees of base portion 12 in the fully open position as shown in FIGS. 2 and 3.

In any event, as shown in FIG. 5, the opening of container 10 exposes two tray assemblies, generally indicated by the numerals 48 and 49, carried by base portion 12, and a pivotal mirror case, generally indicated by the numeral 50, carried within cover 11.

Mirror case 50 includes a body member 51 having an undulating surface which, as will hereinafter become apparent, is designed to aesthetically match other elements within container 10. Tabs 52 extend downwardly from cover top surface 13 to pivotally carry body member 51, as by the pin connections 53. Thus, body member 51 may be swung from the FIG. 2, 5 or 6 position to the tilted or open position shown in FIG. 3. When swung to the open position, a mirror 54, which can be snap fit into body member 51, is exposed to assist the user of container 10 in the application of cosmetics, jewelry or the like. Mirror case 50 may be maintained in the closed position by snapping body member 51 into a clasp 55 (FIGS. 4, 6 and 7) which depends from cover top surface 13.

Tray assembly 48 includes a tray having a bottom surface 56 with side walls 57, an inner wall 58 and an outer wall 59 extending upwardly from bottom surface 56. A divider wall 60 extends between side walls 57 to divide the tray into two compartments 61 and 62. As shown, compartment 61 bottom surface 56 may be undulated to confine cylindrical items of cosmetics, such as lipstick, curlers, eyeliner and the like, while the bottom surface 56 of compartment 62 is shown as being flat for the storage of other items.

Tray assembly 48 also includes a flip-up lipstick holder, generally indicated by the numeral 63, which includes a top surface 64 which is undulated to complement the undulated body member 51 of mirror case 50 and also to hold cylindrical items, such as lipsticks, as will hereinafter be described. The sides of top surface 64 are formed with downturned flanges 65, each of which carries a pin 66 to be received in a socket 67 formed in each tray side wall 57. Lipstick holder 63 is thus pivotal from the closed position shown in FIGS. 2 and 5 to the open position shown in FIGS. 3 and 6.

As probably best shown in FIG. 3, when in the open position, a lipstick holding compartment 68 is exposed for use. Compartment 68 is formed by a bottom surface 69 and side walls 70 extending downwardly from surface 64 of lipstick holder 63. An undulating inner wall 71 spans side walls 70 and is opposed to surface 64. As shown, the opposed undulations in wall 71 and surface 64 are aligned so that a plurality of lipsticks (in this instance five) can be stored for ready access in compartment 68 between opposed matching undulations.

Tray assembly 48 is carried within base portion 12 by a conventional parallelogram linkage system which includes a pair of link arms 72 positioned on each side of tray assembly 48. Tabs 73 extend upwardly from bottom surface 29 of base portion 12, near front surface 35 and rear surface 36 thereof, and carry pins 74 which extend through the lower ends of link arms 72. The upper ends of link arms 72 are pin connected, as at 75, to side walls 57 of tray assembly 48. Thus, tray assembly 48 may be articulated from the stowed position shown in FIG. 5, where it is positioned totally within base portion 12 and supported not only by pins 74 and 75 but also by ribs 76 positioned on link arms 72, to the extended position shown in FIGS. 2, 3 and 6 where it rests on top of skirt 37 of base portion 12. For ease of moving tray assembly 48, a tab 77 may be formed at the top of outer wall 59. Of course, during the lateral articulation of tray assembly 48, link arms 72 rotate on pins 74 and 75 to effect the conventional parallelogram linkage operation.

Like tray assembly 48, tray assembly 49 includes a tray having a bottom surface 78 with side walls 79, an inner wall 80 and an outer wall 81 extending upwardly from bottom surface 78. A divider wall 82 extends between side walls 79 to divide the tray into two compartments 83 and 84. As shown, compartment 83 bottom surface 78 may be undulated to confine cylindrical items of cosmetics, such as lipstick, curlers, eyeliner and the like, while the bottom surface 78 of compartment 84 is flat for the storage of other items. Compartment 84 may be further divided, as desired, by a wall 85 extending from divider wall 82 to inner wall 80.

Tray assembly 49 also includes a flip-up holder, generally indicated by the numeral 86, which is specially adapted to hold items of jewelry such as earrings. Holder 86 includes a main surface 87 which is undulated to complement the undulated body member 51 of mirror case 50 and top surface 64 of lipstick holder 63. The sides of main surface 87 are formed with downturned flanges 88, each of which carries a pin 89 to be received in a socket 90 formed in each tray side wall 79. Holder 86 is thus pivotal from the closed position shown in FIGS. 2 and 5 to the open position shown in FIGS. 3 and 6. Undulated main surface 87 is provided with a plurality of small apertures 91 therethrough which permit the user of container 10 to safely and neatly store items such as post-type earrings thereon.

Like tray assembly 48, tray assembly 49 is carried within base portion 12 by a conventional parallelogram linkage system which includes a pair of link arms 92 positioned on each side of tray assembly 49. Tabs 93 extend upwardly from bottom surface 29 of base portion 12, near front surface 35 and rear surface 36 thereof, and carry pins 94 which extend through the lower ends of link arms 92. The upper ends of link arms 92 are pin connected, as at 95, to side walls 79 of tray assembly 49. Thus, tray assembly 49 may be articulated from the stowed position shown in FIG. 5, where it is positioned totally within base portion 12 and supported not only by pins 94 and 95 but also by ribs 96 positioned on link arms 92, to the extended position shown in FIGS. 2, 3 and 6 where it rests on top of skirt 37 of base portion 12. For ease of moving tray assembly 49, a tab 97 may be formed at the top of outer wall 81. Of course, during the lateral articulation of tray assembly 49, link arms 92 rotate on pins 94 and 95 to effect the conventional parallelogram linkage operation.

Thus, container 10 is compact yet can carry a large volume of cosmetic and jewelry items, and includes tray assemblies having portions specially adapted to carry specific cosmetic and jewelry items. Specifically, all types of items may be stored below tray assemblies 48 and 49 on base bottom surface 29 and access to the same can be obtained by articulating tray assemblies 48 and 49 outward. Moreover, other miscellaneous items can be stored in compartments 61 and 62 of tray assembly 48 and compartments 83 and 84 of tray assembly 49 with access being gained to compartments 61 and 83 by rotating the special item holders 63 and 86. At the same time, container 10 compactly holds mirror case 50 out of the way in cover 11 yet readily accessible to the user.

It should thus be appreciated that a container constructed in accordance with the concepts of the present invention, as described herein, accomplishes the objects of the present invention and otherwise substantially improves the art of storing cosmetic and jewelry items in an organized fashion.

I claim:

1. A container for holding items comprising a base portion having a bottom surface and walls extending upwardly from said bottom surface to form an open top, a cover portion for selectively closing the open top, at least one tray assembly, and pivot means to translate said tray assembly from a position within said open top of said base portion to a position above at least one of said walls of said base portion, said tray assembly including a tray member and an item holding member pivotally connected to said tray member so that said holding member may be pivoted from a position generally within said tray member to a position extending outwardly from said tray member.

2. A container according to claim 1 which is adapted to hold items of a specific configuration and items of any configuration, further comprising a second tray assembly carried by said base portion, said second tray assembly including a pivotal member configured so as to conform to the shape of and to carry items of a specific configuration.

3. A container according to claim 2 further comprising a mirror pivotally carried by said cover portion.

4. A container according to claim 1 which is adapted to hold items of a specific configuration and items of any configuration, wherein said tray assembly includes a compartment formed in said tray member, said compartment having a bottom surface configured so as to conform to the shape of and to carry items of a specific configuration.

5. A container according to claim 4 further comprising a second compartment formed in said tray member, said second compartment being configured to carry items of any configuration.

6. A container according to claim 5 further comprising a second tray assembly carried by said base portion, said second tray assembly including a tray member, a pivotal member pivotally connected to said tray member and configured so as to conform to the shape of and to carry items of a specific configuration, and compartments formed in said tray member of said second tray assembly, at least one of said compartments having a bottom surface configured so as to conform to the shape of and to carry items of a specific configuration.

7. A container according to claim 1 wherein said pivot means includes a linkage mechanism connecting said tray assembly to said base portion.

8. A container according to claim 7 wherein said pivot means includes rib members supporting said tray assembly when said tray assembly is in the position within said open top of said base portion.

9. A container according to claim 7 further comprising a second tray assembly, second pivot means connecting said second tray assembly to said base portion so that said second tray assembly may be translated from a position within said open top to a position over another of said walls such that when said tray assembly and second tray assembly are so translated, said bottom surface is exposed.

10. A container according to claim 1 wherein said tray member includes a plurality of compartments, said holding member closing at least one of said compartments when in the position generally within said tray member.

11. A container according to claim 1 further comprising hinge means pivotally connecting said cover portion to one of said walls.

12. A container according to claim 11 further comprising latch means to selectively connect said cover portion to another of said walls.

13. A container according to claim 1 further comprising a handle carried by said cover portion.

14. A container according to claim 13 further comprising a recess in said cover portion, said handle being pivotally carried by said cover portion such that it may be positioned in said recess.

15. A container for holding specific items and other items comprising a base portion having a bottom surface and side walls and end walls extending upwardly from said bottom surface to form an open top, a cover portion for selectively closing the open top, and a tray assembly carried by said base portion, said tray assembly including a pivotal member having a compartment having opposed undulating walls and the specific item carried by said pivotal member is lipstick received between said opposed undulating walls.

16. A container for holding items Of jewelry or cosmetics of a specific configuration and items of any configuration comprising a base portion having a bottom surface and side walls and end walls extending upwardly from said bottom surface to form an open top, a cover portion for selectively closing the open top, and a tray assembly carried by said base portion, said tray assembly including a tray member and a holding member pivotally attached to said tray member, said holding member having apertures therein, the item of a specific configuration carried by said holding member being earrings received in said apertures.

17. A container for holding items comprising a base portion having a bottom surface and side walls and end walls extending upwardly from said bottom surface to form an open top, a cover portion for selectively closing the open top, a tray assembly carried by said base portion for holding the items, a case pivotally connected to said cover portion, and a mirror carried by said case such that when said case is pivoted from a closed position to an open position, said mirror is exposed.

18. A container according to claim 17 further comprising means to clasp said case to said cover portion to maintain said case in the closed position.

19. A container for holding items comprising a base portion having a bottom surface and side walls and end walls extending upwardly from said bottom surface to form an open top, a cover portion for selectively closing the open top, a recess in said cover portion, a generally U-shaped handle pivotally carried by said cover portion such that it may be positioned in said recess, a hub formed on said cover portion positioned within said handle when said handle is positioned in said recess, said handle and said hub thereby forming a lug on said cover portion, and a recess in said bottom surface, said recess receiving the lug of a like container when the container is stacked on the like container.

* * * * *